US007185680B2

(12) United States Patent
Magno, Jr. et al.

(10) Patent No.: US 7,185,680 B2
(45) Date of Patent: Mar. 6, 2007

(54) CABLE TIE TOOL HAVING VARIABLE TRIGGER LINKAGE

(75) Inventors: Joey D. Magno, Jr., Cordova, TN (US); Anders Fahlen, Skedvi (SE); Johan Tapper, Hedemora (SE)

(73) Assignee: Thomas & Betts International, Inc., Wilmington, DE (US)

( * ) Notice: Subject to any disclaimer, the term of this patent is extended or adjusted under 35 U.S.C. 154(b) by 136 days.

(21) Appl. No.: 11/083,054

(22) Filed: Mar. 17, 2005

(65) Prior Publication Data

US 2005/0217749 A1 Oct. 6, 2005

Related U.S. Application Data

(60) Provisional application No. 60/554,412, filed on Mar. 19, 2004.

(30) Foreign Application Priority Data

Mar. 19, 2004 (SE) ..... 0400706

(51) Int. Cl.
*B21F 9/00* (2006.01)

(52) U.S. Cl. ..... 140/123.6; 140/93.2

(58) Field of Classification Search ..... 140/123.6, 140/93.2

See application file for complete search history.

(56) References Cited

U.S. PATENT DOCUMENTS 3,157,361 A 11/1964 Heard
3,865,156 A 2/1975 Moody et al.
RE29,273 E 6/1977 Reiffin
4,047,545 A 9/1977 Paradis
4,083,497 A 4/1978 Rosenberger
4,093,005 A 6/1978 Eberhardt et al.
RE29,973 E 4/1979 Paradis (Continued)

FOREIGN PATENT DOCUMENTS

EP 0 299 387 A 1/1989

(Continued)

OTHER PUBLICATIONS

Fiskars, "PowerGear Bypass Pruner", The Home Depot, before May 20, 2003 (approximately Feb. 2003), enlargement of illustration.

(Continued)

*Primary Examiner*—Lowell A. Larson
*Assistant Examiner*—Teresa M. Bonk
(74) *Attorney, Agent, or Firm*—Hoffmann & Baron, LLP

(57) ABSTRACT

The cable tie tool has a variable trigger linkage which is supported within a tool handle by a connection thereto. The trigger linkage is coupled to a lever and movable between open and closed positions such that moving the trigger linkage from the open to closed positions causes the lever to pivot from neutral to tensioned positions. The trigger linkage engages the lever alternatively at near or distant positions thereon to couple the trigger linkage to the lever such that, when a uniform force is applied to the trigger linkage for movement thereof from the open to closed positions, the engagement at the distant position results in the force applied to the tool head by the lever being greater than the force applied to the tool head by the lever which results from the engagement at the near position.

13 Claims, 7 Drawing Sheets

U.S. PATENT DOCUMENTS

| | | | |
|---|---|---|---|
| 4,192,358 | A | 3/1980 | Bone |
| 4,410,019 | A | 10/1983 | Suzuki |
| 4,534,817 | A | 8/1985 | O'Sullivan |
| 4,548,242 | A | 10/1985 | Paradis |
| 4,609,149 | A | 9/1986 | Jessen |
| 4,718,460 | A | 1/1988 | Sato |
| 4,726,403 | A | 2/1988 | Young et al. |
| 4,791,968 | A | 12/1988 | Pearson |
| 4,793,385 | A | 12/1988 | Dyer et al. |
| D306,390 | S | 3/1990 | Dyer |
| 4,997,011 | A | 3/1991 | Dyer et al. |
| 5,176,327 | A | 1/1993 | Petersen et al. |
| 5,392,822 | A | 2/1995 | Kraus |
| 5,431,659 | A | 7/1995 | Ross, Jr. et al. |
| 5,492,156 | A | 2/1996 | Dyer et al. |
| 5,518,043 | A | 5/1996 | Cheung et al. |
| D370,962 | S | 6/1996 | Aquilina |
| 5,566,726 | A | 10/1996 | Marelin |
| 5,595,220 | A | 1/1997 | Leban et al. |
| 5,667,143 | A | 9/1997 | Sebion et al. |
| 5,769,133 | A | 6/1998 | Dyer et al. |
| 5,832,964 | A | 11/1998 | Joshi |
| 5,915,425 | A | 6/1999 | Nilsson et al. |
| 6,039,089 | A | 3/2000 | Kurmis |
| 6,047,741 | A | 4/2000 | Kurmis |
| D430,781 | S | 9/2000 | Hillegonds |
| 6,206,053 | B1 | 3/2001 | Hillegonds |
| 6,513,555 | B1 | 2/2003 | Lesser et al. |
| D491,430 | S | 6/2004 | Magno, Jr. et al. |
| 2005/0005993 | A1 | 1/2005 | Magno, Jr. et al. |

FOREIGN PATENT DOCUMENTS

| | | |
|---|---|---|
| EP | 1 108 649 | 6/2001 |
| GB | 1577957 | 10/1980 |
| GB | 2 240 601 A | 8/1991 |
| JP | 2000 168724 | 6/2000 |
| JP | 2000-168724 | 6/2000 |
| JP | 2002 321705 | 11/2002 |

OTHER PUBLICATIONS

Fiskars, "Ergonomics, The Development of Vineyard Cutting Tools", Aug. 29, 2003.

U.S. Design Appl. No. 29/185,986, filed Jul. 7, 2003, Magno, Jr. et al., USPTO Filing Receipt, specification and drawings.

European Search Report for European Patent Application No. EP 04 25 3852, including Annex, attached to European Patent Office Communication dated Jan. 21, 2005 (5 pages).

Partial European Search Report for European Patent Application No. EP 05 07 5328, including Annex, Abstract of EP 05 07 5328, Lack of Unity of Invention—Sheet B, (4 pages).

PCT Notification of Transmittal of the International Search Report and the Written Opinion of the International Searching Authority, or the Declaration for International Application No. PCT/US2005/009319, Jul. 6, 2005 (1 page).

PCT International Search Report for International Application No. PCT/US2005/009319, Jul. 6, 2005 (4 pages).

PCT Written Opinion for International Application No. PCT/US2005/009319, Jul. 6, 2005 (4 pages).

"Communication pursuant to Article 96(2) EPC", European Patent Office, European Patent Application No. 04 253 852.0—1261, Jun. 7, 2006 (4 pages).

"Notification of Reason for Refusal", Japanese Patent Office, Japanese Patent Application No. 2004-2000020, Dec. 19, 2005 (Japanese language, 2 pages, English language translation, 1 page).

Office communication, U.S. Appl. No. 10/614,435, Sep. 26, 2005 (13 pages).

Office communication, U.S. Appl. No. 10/614,435, Jun. 28, 2006 (5 pages).

Office Action, Canadian Intellectual Property Office, Canadian Patent Application No. 2,471,183, Jun. 28, 2006 (3 pages).

CABLE TIE TOOL HAVING VARIABLE TRIGGER LINKAGE

CROSS-REFERENCE TO RELATED APPLICATION

This patent application claims priority to and the benefit of U.S. Provisional Patent Application No. 60/554,412 filed in the U.S. Patent and Trademark Office (USPTO) on Mar. 19, 2004, and Sweden Patent Application No. 0400706-8 filed on Mar. 19, 2004, the entire disclosures of all of which are hereby incorporated by reference herein.

BACKGROUND OF THE INVENTION

The present invention relates generally to a cable tie tool having a variable trigger linkage, and more specifically, to such a trigger linkage which may provide different tensioning forces to the tool head of the cable tie tool.

Cable ties are used to bundle or secure a group of articles such as electrical wires or cables. Cable ties of conventional construction include a cable tie head and an elongate strap extending therefrom. The strap is wrapped around a bundle of articles and thereafter inserted through a passage in the head. The head of the cable tie typically supports a locking element which extends into the head passage allowing the strap to be inserted through the passage but preventing retraction of the strap through the passage in the head. Two longitudinally separated portions of the strap are thereby secured to the head to define a loop for holding together the group of articles.

In use, the installer manually places the tie about the articles to be bundled, inserts the strap through the head passage and then manually tightens the tie about the bundle. Further tightening of the cable tie, which increases the tension in the strap thereof, may be provided by a cable tie tool.

One type of such a cable tie tool includes a handle which is generally pistol-shaped and has a barrel into which the strap may be inserted for application of the tension thereto. The handle has a grip which depends from the barrel. The tool includes a trigger mechanism a portion of which is supported within a trigger housing located under the barrel and in front of the grip. The trigger housing is elongate and in generally depending relation relative to the barrel such that, when the heel of the hand of a user is placed against the grip such that the fingers of the hand of the user extend forwardly, the fingers may encircle the forward surface of the trigger housing. Forcibly drawing the fingers toward the heel of the hand, such as by squeezing the trigger housing and grip, causes the trigger housing to be displaced toward the grip. The trigger mechanism is also supported within the barrel and is able to grasp the strap, and to apply the tension thereto in proportion to the drawing or squeezing force applied to the trigger housing.

The ratio of the tension force applied to the cable tie to the drawing or squeezing force applied to the trigger housing is frequently constant and determined by the trigger mechanism. As a result, if an increased tension force is to be applied to the cable tie, a correspondingly larger drawing or squeezing force is required to be applied to the trigger housing.

The application of larger tension forces to a cable tie is frequently required as a cable tie is tensioned because the cable tie normally resists further tensioning after having been subjected to previous tension, particularly if such previous tension is substantial. This, in turn, frequently requires the application of increased drawing or squeezing forces to the trigger housing which are normally provided by the hand of the user. If the required drawing or squeezing forces become sufficiently large, the hand of the user may encounter difficulty in providing such forces.

SUMMARY OF THE INVENTION

The cable tie tool of the present invention includes a tool handle having a barrel structure and a tool head supported within the barrel structure. The tool head has a forward end to which may be secured a cable tie for tensioning thereof.

An elongate lever is supported within the tool handle by a pivotal connection thereto. The lever has near and distant positions thereon which have corresponding longitudinal reduced and increased separations from the pivotal connection. The lever is coupled to the tool head and pivotal between neutral and tensioned positions such that, when a cable tie is secured to the tool head, pivoting the lever from the neutral to tensioned positions causes the lever to apply a force to the tool head to increase the tension in the cable tie in proportion to the force applied to the tool head by the lever.

The cable tie tool includes a variable trigger linkage supported within the tool handle by a connection thereto. The trigger linkage is coupled to the lever and movable between open and closed positions such that moving the trigger linkage from the open to closed positions causes the lever to pivot from the neutral to tensioned positions. The trigger linkage engages the lever alternatively at the near or distant positions to provide the coupling to the lever such that, when a uniform force is applied to the trigger linkage for movement thereof from the open to closed positions, the engagement at the distant position results in the force applied to the tool head by the lever being greater than the force applied to the tool head by the lever which results from the engagement at the near position.

The variable trigger linkage provides for the application of two different forces by the lever to the tool head depending upon whether the trigger linkage engages the lever at the near or distant positions thereon. Since the tension force applied to the cable tie by the tool head is related to the force applied thereto by the lever, different tension forces are applied to the cable tie by the tool head depending upon the force applied thereto by the trigger linkage.

The application of different tension forces to a cable tie by the trigger linkage provides for the application of a greater tension force as the cable tie is progressively tensioned. This is advantageous because progressive tensioning of the cable tie will frequently require the application of higher tension forces thereto. The variable trigger linkage provides for the application of such higher tension forces from the application of a uniform drawing or squeezing force to the trigger linkage by the user. As a result, an increased drawing or squeezing force by the hand of the user is not required for the trigger linkage to apply the increased force to the tool head and, consequently, to the cable tie. The user, and more particularly the hand thereof, is thereby relieved of the difficulties associated with having to apply increasing large drawing or squeezing forces to the trigger linkage and grip.

These and other features of the invention will be more fully understood from the following description of specific embodiments of the invention taken together with the accompanying drawings.

BRIEF DESCRIPTION OF THE DRAWINGS

In the drawings.

Corresponding reference characters indicate corresponding parts throughout the several views of the drawings.

DETAILED DESCRIPTION OF THE INVENTION

Figure 1:
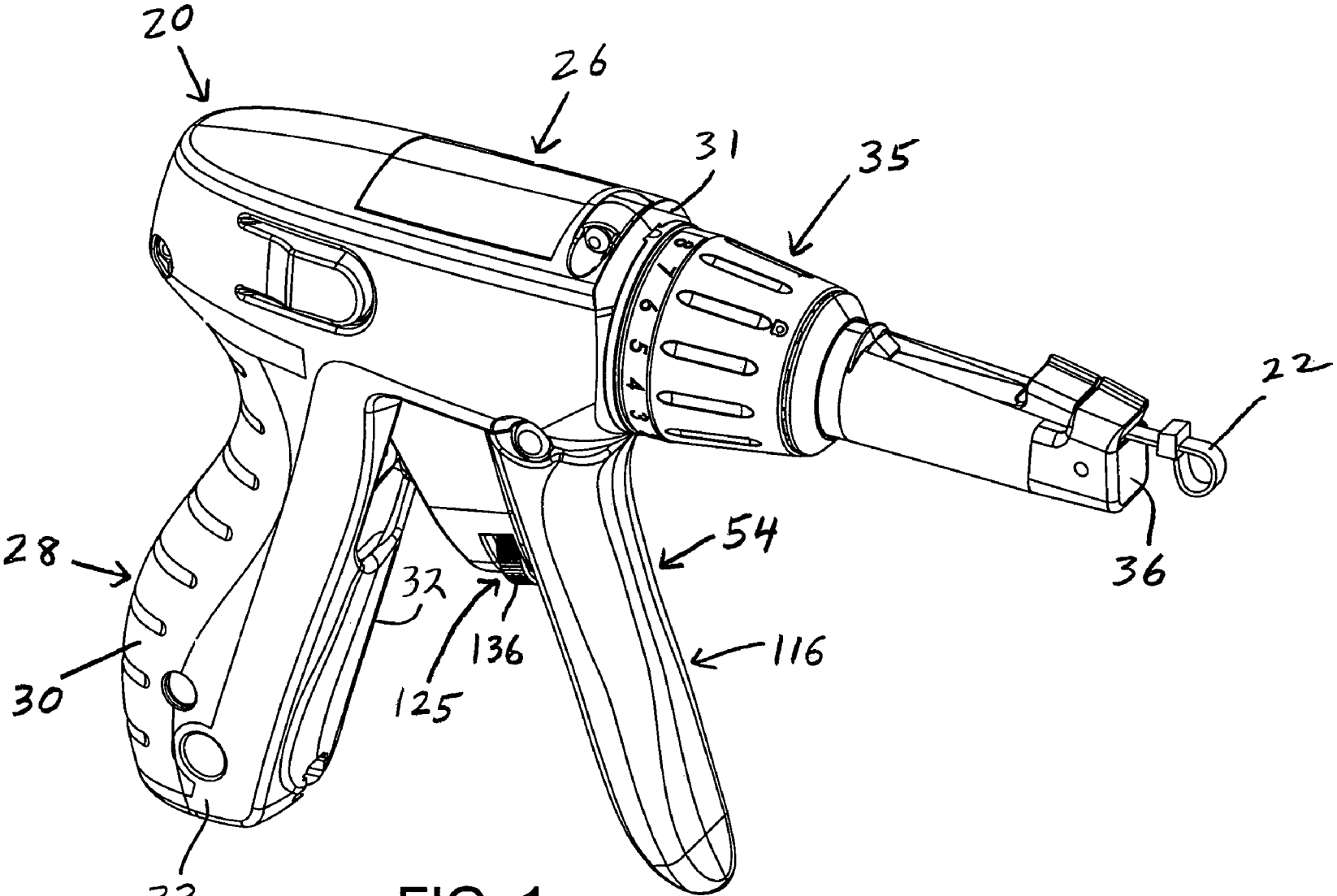
FIG. 1 is a right side perspective view of a cable tie tool containing a variable trigger linkage of the present invention.
Figure 2:
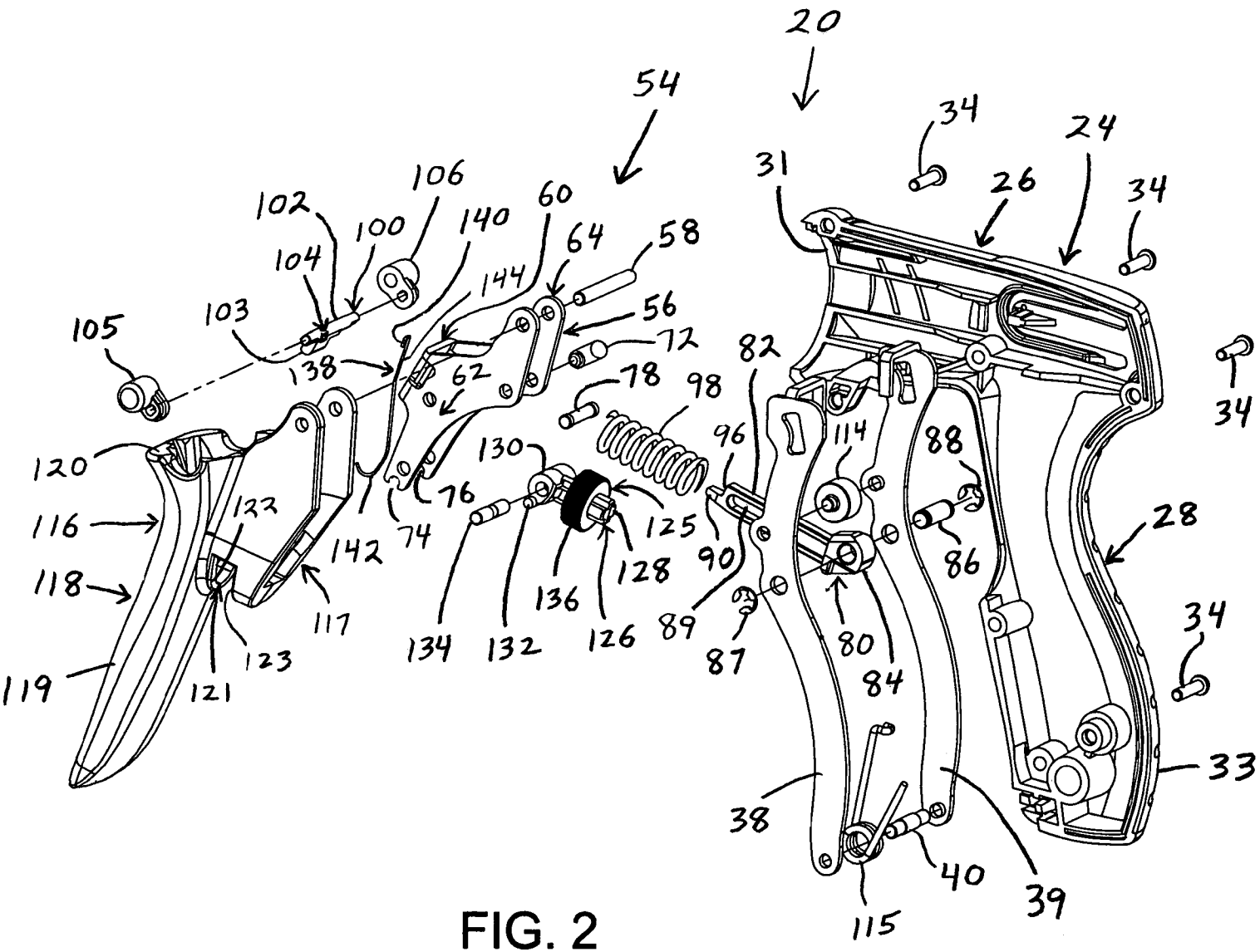
FIG. 2 is an exploded view of the cable tie tool of FIG. 1, the tool head and left section of the tool handle being removed to show the variable trigger linkage.
Figure 7:
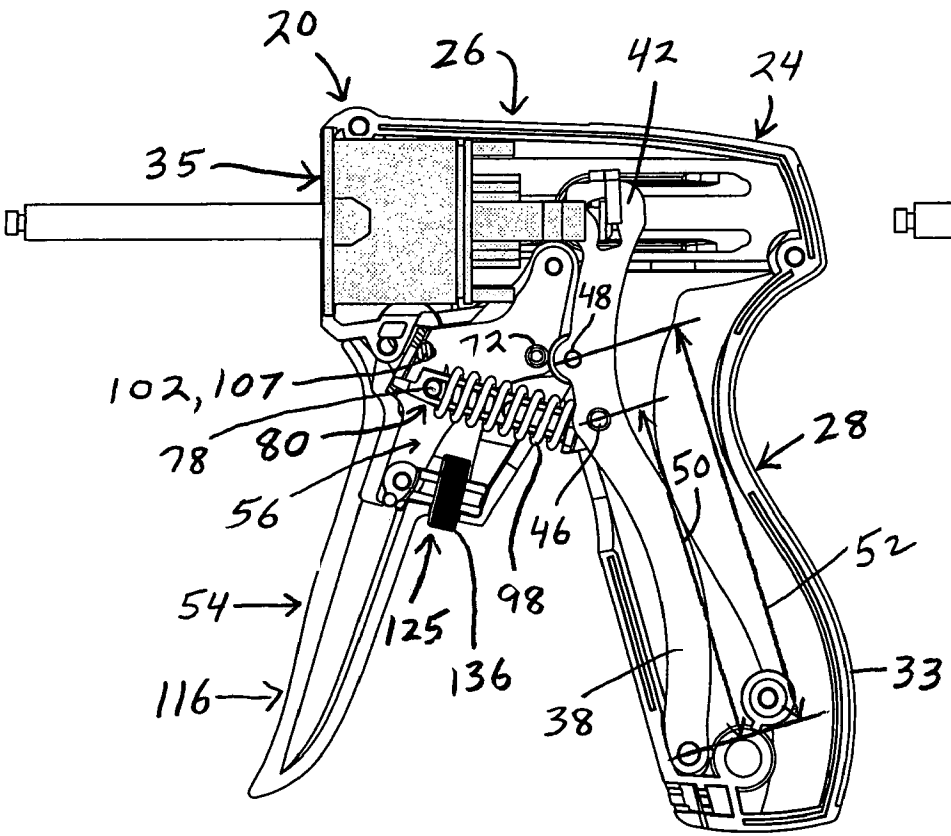
FIG. 7 is a side elevation view of the cable tie tool of FIG. 1 showing the left section of the tool handle removed, the variable trigger linkage being shown in the open position and having the automatic gear engaged, the hand-size adjustment of the variable trigger linkage being shown for a large hand.
Figure 10:
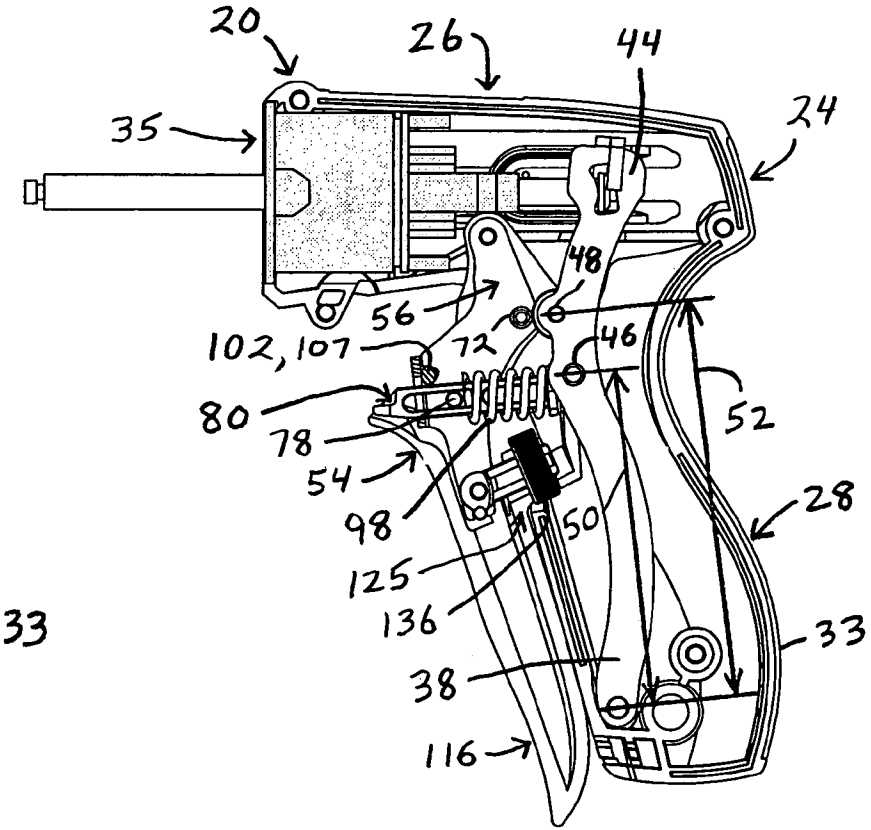
FIG. 10 is a side elevation view corresponding to FIG. 9 showing the variable trigger linkage in the closed position.

Referring to the drawings and more particularly FIGS. 1, 2, and 7, a cable tie tool 20 is shown for securing a cable tie 22 to a bundle of articles, such as wires or cables. The cable tie tool 20 includes a tool handle 24 having a pistol-shape. The tool handle 24 includes a barrel structure 26 and a grip structure 28 which depends from the barrel structure. The grip structure 28 has an outer surface 30 which is grasped by the palm of the hand of a user when the tool handle 24 is grasped by the user. The barrel structure 26 has elongate cavity 30 and an open forward end 31 which provides access thereto. The tool handle 24 has left and right sections 32, 33 which are held together by pins 34.

As used herein, the "rearward direction" indicates the direction, for example, from the forward end 31 to the grip structure 28. The "forward direction" indicates the direction which is opposite to the rearward direction. "Left" and "right" indicate the sides of one which is facing in the forward direction.

The cable tie tool 20 includes a tool head 35 which is supported within the cavity 30 of the barrel structure 26. The tool head 35 has a forward end 36 to which the cable tie 22 is secured for tensioning thereof. Examples of the tool head 35 are disclosed in U.S. Pat. No. 5,915,425 issued by the USPTO on Jun. 29, 1999, U.S. patent application Ser. No. 11/056,078 filed in the USPTO on Feb. 11, 2005, and U.S. patent application Ser. No. 11/055,929 filed in the USPTO on Feb. 11, 2005, the entire disclosures of all of which are hereby incorporated by reference herein.

The cable tie tool 20 includes elongate left and right levers 38, 39 each of which is supported within the tool handle 24 by a lever pin 40 which is supported on the inner surface of the grip structure 28. The lever pin 40 provides a pivotal connection between the levers 38, 39 and the grip structure 28 for pivoting of the levers between neutral and tensioned positions 42, 44.

The levers 38, 39 are coupled to the tool head 35 such that, when the cable tie 22 is secured to the tool head 35, pivoting the levers 38, 39 from the neutral to tensioned positions 42, 44 causes the levers to apply a force to the tool head to increase the tension in the cable tie in proportion to the force applied to the tool head by the levers. The levers 38, 39 each have near and distant positions 46, 48 thereon which have respective longitudinal reduced and increased separations 50, 52 from the lever pin 40.

The cable tie tool 20 includes a trigger linkage 54 having a trigger frame 56 the upper portion of which is supported within the tool handle 24 and pivotally connected thereto by a trigger pin 58. The trigger pin 58 extends laterally across the interior region of the tool handle 24 and is connected to the inner surface of the grip structure 28.

Figure 5:
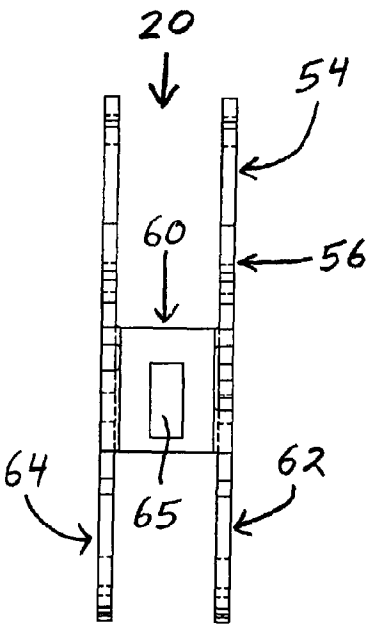
FIG. 5 is a front elevation view of the trigger frame of FIG. 3.
Figure 4:
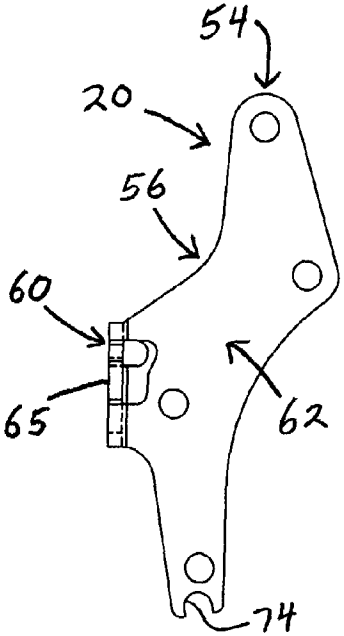
FIG. 4 is a left side elevation view of the trigger frame of FIG. 3.
Figure 3:
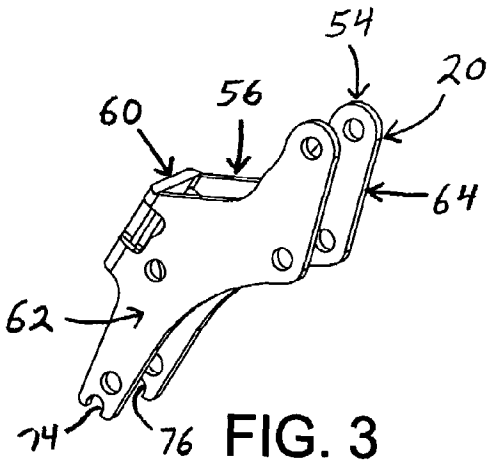
FIG. 3 is a left side perspective view of the trigger frame of FIG. 2.
Figure 6:
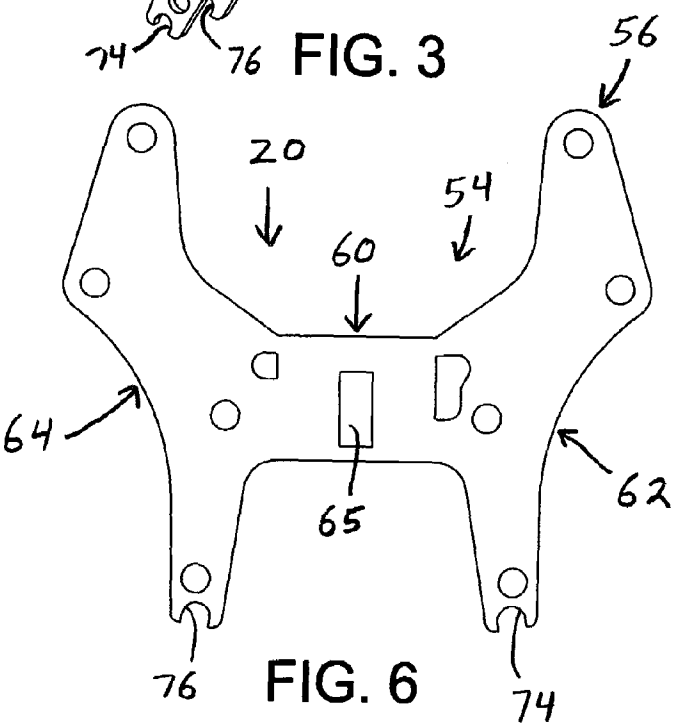
FIG. 6 is a front elevation view corresponding to FIG. 5 showing the trigger frame in a planar configuration before bending thereof to the configuration shown in FIG. 3.

The trigger frame 56 includes a web structure 60 and left and right flange structures 62, 64 as shown in FIGS. 3, 4, and 5. The web structure 60 has a rectangular aperture 65. The flange structures 62 spread upward and downward from the web structure 60, as shown in FIG. 4. The web and flange structures 60, 62, 64 may be an integral, unitary structure and formed from a single plate 66, an example of which is illustrated in FIG. 6. The plate 66 is bent to form the trigger frame 56. The trigger frame 56 is oriented relative to the grip structure 28 such that the web structure 60 is to the front of the flange structures 62, 64. The upper ends of the flange structures 62, 64 are hung from the trigger pin 58 to provide for pivoting of the trigger frame 56 in the forward and rearward direction relative to the tool handle 24.

Figure 8:
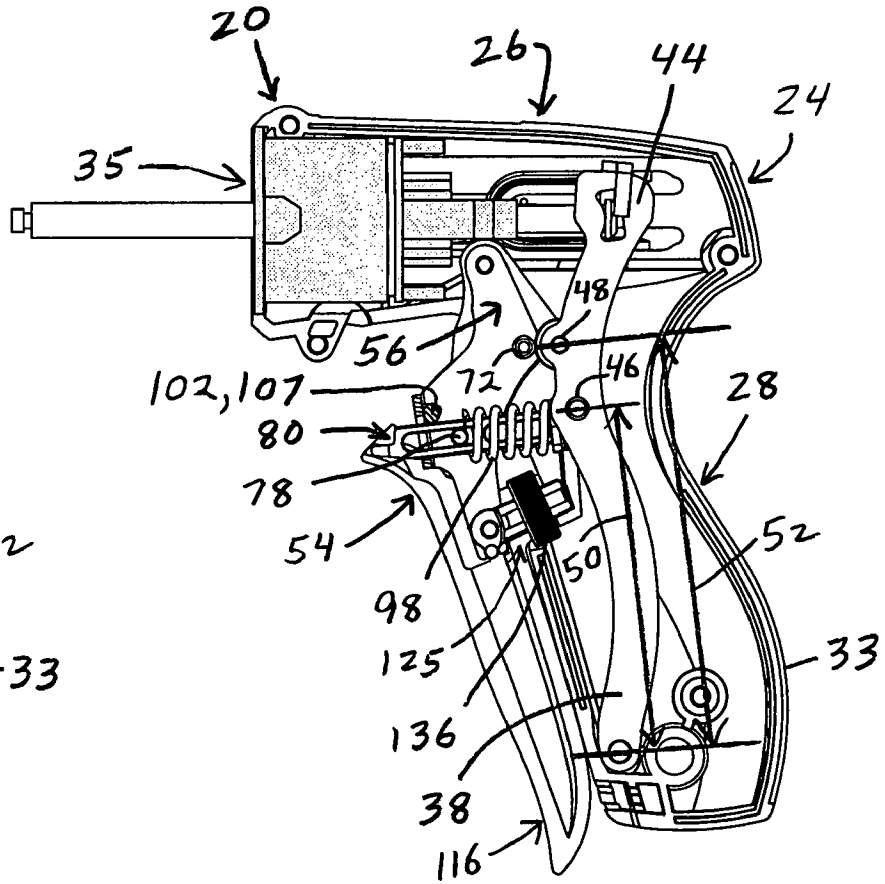
FIG. 8 is a side elevation view corresponding to FIG. 7 showing the variable trigger linkage in the closed position.

The trigger frame 56 includes left and right slots 68, 70 which are formed in the left and right flange structures 62, 64 such that the left and right slots are each contiguous with the web structure 60. Also, the trigger frame 56 includes a gear pin 72 which extends between the flange structures 62, 64 and is connected thereto. The connection between the gear pin 72 and flange structures 62, 64 may provide for rotation of the gear pin relative thereto. The trigger frame 56 has semi-circular left and right recesses 74, 76 in the lower edges of the flange structures 62, 64. The trigger frame 56 includes a guide pin 78 which extends between the flange structures 62, 64 and is connected thereto. The guide pin 78 is to the rear of the web structure 60, as shown in FIGS. 7 and 8.

The trigger linkage 54 includes a push rod 80 having an elongate body 82 and an enlarged head 84 which is integral with the rear end of the body. The head 84 is supported between the levers 38, 39 and pivotally connected thereto by a push rod pin 86. The push rod pin 86 extends between the near positions 46 of the levers 38, 39 and is connected thereto. The push rod pin 86 extends through the head 84 to provide for upward and downward pivoting of the push rod 80 relative to the levers 38, 39. Left and right E-clips 87, 88 are fastened to the corresponding ends of the push rod pin 86 such that the respective E-clips are to the left and right of the corresponding levers 38, 39. The E-clips 87, 88 restrain the push rod pin 86 from lateral displacement relative to the levers 38, 39 and head 84.

The body 82 of the push rod 80 extends forwardly from the head 84 into the interior of the trigger frame 56 between the flange structures 62, 64. The body 82 has a slot 89 which extends through a longitudinal portion thereof, as shown in FIGS. 2 and 7. The slot 89 is located to the rear of and adjacent to the forward end 90 of the body 82 The body 82 is oriented relative to the flange structures 62, 64 such that guide pin 78 extends through the slot 89. The extension of the guide pin 78 through the slot 89 provides vertical support to the body 82 and limits the upward and downward pivoting thereof about the push rod pin 86 relative to the levers 38, 39. The diameter of the guide pin 78 and transverse dimension of the slot 89 provide a vertical clearance between the guide pin and slot such that the longitudinal position of the guide pin within the slot may change. The guide pin 78 engages the forward end of the slot 89 when the trigger frame 56 is pivoted sufficiently about the trigger pin 58 in the forward direction. Consequently, the pivoting of the trigger frame 56 in the forward direction is limited by the engagement of the guide pin 78 with the forward end of the slot 89.

The forward end 90 of the body 82 of the push rod 80 has a reduced cross-sectional area and extends through the aperture 65 in the web structure 60. This allows longitudinal displacement of the push rod 80 relative to the web structure 60 which, in turn, allows forward and rearward pivoting of the trigger frame 56 about the trigger pin 58 relative to the tool handle 24. The push rod 80 has a shift surface 96 which is forward facing and located at the intersection between the body 82 and forward end 80.

The trigger linkage 54 includes a helical drive spring 98 which is supported on the push rod 80 in coaxial relation therewith as shown in FIGS. 2 and 7. The rear end of the drive spring 98 abuts the head 84 of the push rod 80. The front end of the drive spring 98 abuts the guide pin 78 of the trigger frame 56. Consequently, rearward pivoting of the trigger frame 56 compresses the drive spring 98 which, in turn, imparts a rearward force to the head 84 of the push rod 80. This, in turn, imparts a rearward force to the push rod pin 86 which urges the levers 38, 39 to pivot about the lever pin 40 in the rearward direction. The drive spring 98, when compressed, imparts a forward force against the guide pin 78 which, in the absence of a sufficiently large opposing force applied to the trigger frame 56, urges the guide pin in the forward direction to produce corresponding forward pivoting of the trigger frame.

Figure 11:
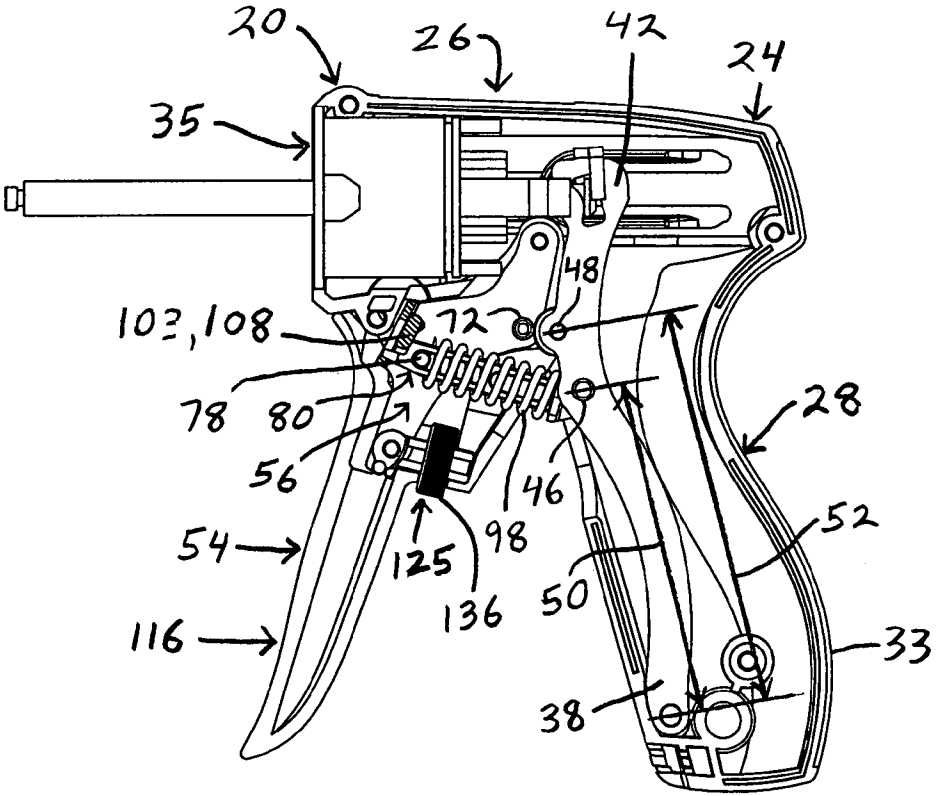
FIG. 11 is a side elevation view of the cable tie tool of FIG. 1 showing the left section of the tool handle removed, the variable trigger linkage being shown in the open position and having the fixed gear engaged, the hand-size adjustment of the variable trigger linkage being shown for a large hand.
Figure 14:
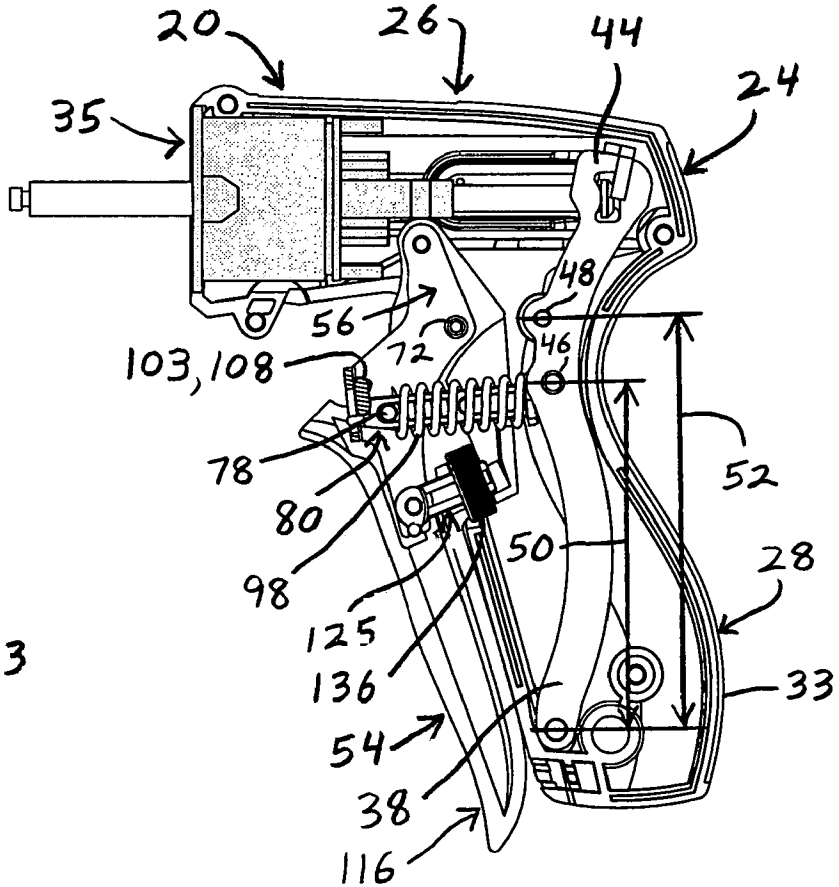
FIG. 14 is a side elevation view corresponding to FIG. 13 showing the variable trigger linkage in the closed position.

The trigger linkage 54 includes a shift structure 100 which is supported within the trigger frame 56, as shown in FIGS. 2, 7, and 11. The shift structure 100 includes a lateral member 102 and a detent structure 103 depending therefrom. The shift structure 100 includes three locator projections 104 which extend in the rearward direction from the lateral member 102 in integral relation therewith. The locator projections 104 are positioned laterally to the left of the detent structure 103. Also, the locator projections 104 are positioned laterally relative to one another to define a center projection and left and right projections which are located to the left. and right of the center projection, respectively. The left and right projections of the locator projections 104 each have respective longitudinal dimensions which are the same, and the center projection has a longitudinal dimension which is greater than the longitudinal dimensions of the left and right projections.

The detent structure 103 is laterally offset between the ends of the lateral member 102. The shift structure 100 includes left and right knobs 105, 106 which are fixed to the left and right ends of the lateral member 102, respectively. The lateral member 102 extends through the left and right slots 68, 70 such that the left and right knobs 105, 106 are to the left and right of the left and right flange structures 62, 64, respectively.

The length of the lateral member 102 is greater than the lateral dimension between the outer surfaces of the left and right flange structures 62, 64 to provide for lateral displacement of the shift structure 100 relative to the trigger frame 56. The lateral displacement is limited by the engagement between the knobs 105, 106, and the outer surfaces of the left and right flange structures 62, 64. This limitation results from the knobs 105, 106 being offset from the axis of the lateral member 102, and the cross-sectional areas of the knobs being larger than the area of the slots 68, 70. Consequently, displacement of the shift structure 100 to the right relative to the trigger frame 56 is limited by the engagement of the left knob 105 with the outer surface of the left flange structure 62. Displacement of the shift structure 100 to the left relative to the trigger frame 56 is limited by the engagement of the right knob 106 with the outer surface of the right flange structure 64.

The lateral offset of the detent structure 103 provides for the detent structure to be closer to the left knob 105 as compared to the right knob 106. Further, the dimension between the detent structure 103 and the left knob 105 provides for the detent structure to be midway between the left and right flange structures 62, 64 when the left knob 105 is in flush contact with the outer surface of the left flange structure.

The positioning of the detent structure 103 to the left of the body 82 of the push rod 80 results in the detent structure not obstructing rearward translation of the trigger frame 56 relative to the push rod 80 and, consequently, defines the disengaged position 107 of the shift structure 100. The disengaged position 107 is obtained by laterally displacing the right knob 106 to the left, relative to the trigger frame 56, to bring the right knob into flush contact with the outer surface of the right flange structure 64. This displacement of the detent structure 103 to the left of the body 82 is sufficient to establish a lateral clearance between the detent structure and body 82 such that the detent structure is to the left thereof. The lateral clearance results from the dimension between the detent structure 103 and the right knob 106 and is sufficient such that the detent structure 103 does not obstruct rearward translation of the trigger frame 56 relative to the push rod 80.

The positioning of the detent structure 103 midway between the left and right flange structures 62, 64 provides for the detent structure to engage the shift surface 96 of the push rod 70. The engagement between detent structure 103 and shift surface 96 results in rearward pivoting of the trigger frame 56 producing corresponding rearward translation of the push rod 80. This engagement also results in forward translation of the push rod 80 producing corresponding forward pivoting of the trigger frame 56. Consequently, the positioning of the detent structure 103 midway between the left and right flange structures 62, 64 defines the engaged position 108 of the shift structure 100. The engaged position 108 is obtained by laterally displacing the left knob 105 to the right, relative to the trigger frame 56, to bring the left knob into flush contact with the outer surface of the left flange structure 62. The contact of the left knob 105 with the left flange structure 62 results in the detent structure 103 being midway between the left flange structure and right flange structures 64 as a result of the dimension between the left knob and detent structure.

The trigger linkage 54 includes a gear wheel 114 which extends between the distant positions 48 of the left and right levers 38, 39 and is connected thereto. The connection between the gear wheel 114 and levers 38, 39 may provide for rotation of the gear wheel relative thereto. The gear wheel 114 may be engaged by the gear pin 72 when the trigger frame 56 is pivoted in the rearward direction. Following such engagement, continued rearward pivoting of the trigger frame 56 results in rearward pivoting of the left and right levers 38, 39 in the rearward direction. Preferably, one or both of the gear pin 72 and gear wheel 114 may rotate relative to the trigger frame 56 and levers 38, 39, respectively, to reduce possible sliding friction between the surfaces of the gear pin and wheel which contact one another.

The trigger linkage 54 includes a lever return spring 115 which is connected to the right lever 39 and inner surface of the grip structure 28 for resisting pivoting of the right lever from the neutral to tensioned positions 42, 44. This resistance to the pivoting of the right lever 39 provides a corresponding resistance to the pivoting of the left lever 38 from the neutral to tensioned positions 42, 44 as a result of the lateral connections between the left and right levers provided by the gear wheel 114 and push rod pin 86.

The trigger linkage 54 includes a trigger housing 116 having a U-shaped rear section 117 and an elongate front section 118 in depending relation therewith. The trigger housing 116 is a one-piece unitary structure in which the rear section 117 is integral with the front section 118. The upper portion of the rear section 117 is supported within the tool handle 24 and pivotally connected thereto by the trigger pin 58. The front section 118 has an outer surface 119 which is grasped by the fingers of the hand of a user when the tool handle 24 is grasped by the user. The grasping of the trigger housing 116 by the user, if sufficiently forceful, results in pivoting of the trigger housing about the trigger pin 58 in the rearward direction from the open to closed positions thereof.

The pivoting of the trigger housing 116 in the forward direction is limited by the engagement of an upper edge 120 of the front section 118 with the lower surface of the barrel structure 26, which defines the rest position of the trigger housing shown in FIGS. 7, 9, 11, and 13. The pivoting of the trigger housing 116 in the forward direction beyond the rest position may be limited by the engagement between other components of the cable tie tool, such as the engagement between the upper ends of the levers 38, 39 and rear end of the tool head 35.

The rear section 117 of the trigger housing 116 has a cutout 121 in the lower end thereof. The cutout 121 has a lateral cross-section which is U-shaped. The cutout 121 is bordered to the front and rear thereof by front and rear edges 122, 123 of the rear section 117. The trigger frame 56, which is also pivotally connected to the tool handle 24 by the trigger pin 58, is supported within the rear section 117 of the trigger housing 116.

The trigger linkage 54 includes a hand-size adjustment mechanism 125 through which the trigger housing 116 is coupled to the trigger frame 56. The adjustment mechanism 125 includes an adjustment rod 126 having an elongate body 128 and an enlarged head 130 which is integral with the forward end of the body. The adjustment rod 126 has a left stop pin 132 and a right stop pin each of which extends laterally from the lower surface of the head 130 in integral relation therewith. The head 130 is supported between the left and right flange structures 62, 64 and pivotally connected thereto by an adjustment pin 134. Sufficient pivoting of the body 128 relative to the trigger frame 56 in the upward direction results in the left stop pin 132 and right stop pin each becoming lodged in the left and right recesses 74, 76 which, consequently, limits the degree of such upward pivoting of the adjustment rod 126.

The body 128 of the adjustment rod 126 is externally threaded. The adjustment mechanism 125 includes an adjustment wheel 136 which is internally threaded to provide for the wheel to be screwed onto the externally threaded body 128. The threaded engagement between the wheel 136 and body 128 results in rotation of the wheel relative to the body 128 results in longitudinal translation of the wheel relative to the body. The adjustment wheel 136 has an outer surface which is roughened or uneven to facilitate gripping thereof by the user.

The trigger housing 116 is arranged relative to the adjustment mechanism 125 for the location thereof within the rear section 117. The arrangement further provides for access through the cutout 121 to the adjustment wheel 136 and, more specifically, to the bottom and side portions of the outer surface of the wheel for gripping thereof by a finger or thumb of the hand of the user for rotation of the wheel.

The adjustment wheel 136 has an outer diameter which is sufficiently large to extend downwardly into the cutout 121. Consequently, forward and rearward translation of the wheel 136 relative to the body 128 of the adjustment rod 126 results in engagement of the wheel with the respective front and rear edges 122, 123 of the rear section 117. Such engagement causes corresponding forward or rearward pivoting of the trigger housing 116 relative to the trigger frame 56.

The trigger linkage 54 includes an elongate locator spring 138 for maintaining the shift structure 100 in the disengaged or engaged positions 107, 108. The locator spring 138 is located between the left and right flange structures 62, 64 and to the rear of the web structure 60. The upper end of the locator spring 138 is formed into an upper hook 140 which extends in the leftward direction. The lower end of the locator spring 138 is formed into a lower hook 142 which extends in the forward direction. The upper hook 140 overhangs the upper edge of the left flange structure 62 and the lower hook 142 extends around the lower surface of the head 130 of the adjustment rod 126 such that the locator spring is supported by the head of the adjustment rod and the left flange structure. The locator spring 138 has an intermediate portion 144 between the upper and lower hooks 140, 142.

The locator spring 138 is positioned laterally relative to the shift structure 100 such that the intermediate portion 144 extends between the left and center projections of the locator projections 104 when the shift structure is laterally positioned in the disengaged position 107. The location of the intermediate portion 144 between the left and center projections of the locator projections 104 maintains the shift structure 100 in the disengaged position 107 by providing resistance to lateral translation of the lateral member 102.

The lateral position of the locator spring 138 relative to the shift structure 100 further provides for the intermediate portion 144 to extend between the center and right projections of the locator projections 104 when the shift structure is laterally positioned in the engaged position 108. The location of the intermediate portion 144 between the center and right projections of the locator projections 104 maintains the shift structure 100 in the engaged position 108 by providing resistance to lateral translation of the lateral member 102. The increased longitudinal dimension of the center projection of the locator projections 104 provides further resistance to lateral translation of the shift structure 100 between the disengaged and engaged positions 107, 108.

In operation, the hand-size adjustment mechanism 125 is manipulated to adjust the separation in the forward direction between the front surface of the trigger housing 116 and the rear surface of the grip structure 28 to fit the size of the hand of the user of the cable tie tool 20. This is done by rotating the adjustment wheel 136 to cause forward or rearward translation thereof relative to the body 128 of the adjustment rod 126. Forward translation of the wheel 136 relative to the body 128 causes engagement thereof with the front edge 122 of the rear section 117. Continued forward translation of the wheel 136 results in corresponding forward pivoting of the rear section 117 and, consequently, forward pivoting of the trigger housing 116 relative to the trigger frame 56. The forward pivoting increases the separation in the forward direction between the front surface of the trigger housing 116 and the rear surface of the grip structure 28. Examples of the adjustment mechanism 125 manipulated to provide the increased separation are shown in FIGS. 7, 8, 11, and 12. Increasing the separation between the trigger housing 116 and grip structure 28 is normally desirable when the size of the hand of the user of the cable tie tool 20 is relatively large.

When the hand of the user of the cable tie tool 20 is relatively small, the hand-size adjustment mechanism 125 is manipulated to translate the wheel 136 in the rearward direction relative to the body 128. Consequently, the wheel 136 engages the rear edge 123 of the rear section 117. Continued rearward translation of the wheel 136 results in corresponding rearward pivoting of the rear section 117 and, consequently, rearward pivoting of the trigger housing 116 relative to the trigger frame 56. The rearward pivoting decreases the separation in the rearward direction between the front surface of the trigger housing 116 and the rear surface of the grip structure 28. Examples of the adjustment mechanism 125 manipulated to provide the decreased separation are shown in FIGS. 9, 10, 13, and 14. Decreasing the separation between the trigger housing 116 and grip structure 28 is normally desirable when the size of the hand of the user of the cable tie tool 20 is relatively small.

The trigger linkage 54 may be shifted between automatic gear operation or fixed gear operation by positioning the shift structure 100 in the disengaged or engaged positions 107, 108, respectively. More specifically, the trigger linkage 54 is shifted to the automatic gear operation by moving the shift structure 100 to the disengaged position 107 which is obtained by pushing the right knob 106 of the shift structure 100 laterally to the left into abutment with the outer surface of the right flange structure 64. The right knob 106 is pushed with sufficient force to overcome the resistance of the locator spring 138 to the corresponding lateral translation of the locator projections 104. The moving of the right knob 106 into abutment with the right flange structure 64 results in a corresponding displacement of the detent structure 103 laterally to the left which is sufficient to establish the lateral clearance between the detent structure and body 82 of the push rod 80. When the shift structure 100 is in the disengaged position 107, the detent structure 103 does not obstruct rearward translation of the trigger frame 56 relative to the push rod 80. Examples of the shift structure 100 in the disengaged position 107 and, consequently, the trigger linkage 54 configured for automatic gear operation are shown in FIGS. 7, 8, 9, and 10.

The user grasps the cable tie tool 20 such that the outer surface 30 of the grip structure 28 is grasped by the palm of the hand of a user and the fingers of the hand wrap around the outer surface 119 of the front section 118 of the trigger housing 116. The hand is then forcibly closed to draw the trigger housing 116 in the rearward direction toward the grip structure 28 to pivot the trigger housing from the open to closed positions thereof. Consequently, the trigger housing 116 is pivoted in the rearward direction which causes the front edge 122 of the rear section 117 to drive the adjustment wheel 136 in the rearward direction. This, in turn, causes the wheel 136 to pull the adjustment rod 126 in the rearward direction which results in pivoting of the trigger frame 56 in the rearward direction.

Pivoting of the trigger frame 56 in the rearward direction causes the guide pin 78 to be driven in the rearward direction which results in the guide pin translating through the slot 89 in the push rod 80 and displacing the front end of the drive spring 98 in the rearward direction. This results in compression of the drive spring 98, translation of the rear end of the drive spring 98 in the rearward direction, or both. Rearward translation of the rear end of the drive spring 98 causes corresponding rearward displacement of the head 84 of the push rod 80. Rearward displacement of the head 84 results in pivoting of the left and right levers 38, 39 in the rearward direction from the neutral to the tensioned positions 42, 44. Consequently, the coupling between the trigger frame 56 and levers 38, 39 is provided through the near positions 46. Also, the pivoting of the left and right levers 38, 39 in the rearward direction results in the compression of the lever return spring 115.

The rearward pivoting of the levers 38, 39, as a result of the coupling thereof to the tool head 35, causes in an increase in the tension in the cable tie 22 which is secured thereto. Additionally, when the compression of the drive spring 98 is sufficiently limited, the rearward pivoting of the levers 38, 39 results in rearward displacement of the gear wheel 114 relative to the gear pin 72 causing rearward separation of the gear wheel from the gear pin.

Typically, as the tension in the cable tie 22 is increased, further increases in the tension thereof are resisted by the cable tie. This resistance is transmitted through the trigger linkage 54 to the trigger housing 116 which results in increasingly greater force being required to be applied to the outer surface 119 of the front section 118 by the fingers of the user for continued pivoting of the trigger housing in the rearward direction. Application of increasingly greater force to the trigger housing 116 further compresses the drive spring 98 between the guide pin 78 and head 84 of the push rod 80.

Compression of the drive spring 98 results in the separation between the gear wheel 114 and the gear pin 72 decreasing. When the compression of the drive spring 98 is sufficient, the gear pin 72 contacts the gear wheel 114 such that the trigger frame 56 drives the rearward pivoting of the levers 38, 39 through the gear pin 72 and gear wheel rather than through the drive spring 98 and push rod pin 86, which provides the coupling before the engagement between the gear pin and wheel. Consequently, the coupling between the trigger frame 56 and levers 38, 39 is provided through the distant positions 48.

The transfer of the coupling from the near positions 46 to the distant positions 48 results in an increase in the force applied to the tool head 35 by the rearward pivoting of the levers 38, 39 for a uniform force applied to the trigger housing 116 for pivoting thereof in the rearward direction from the open to closed positions. The increase in the force applied to the tool head 35 results from the increased separation 52 between the gear wheel 114 and lever pin 40 as compared to the reduced separation 50 between the push rod pin 86 and lever pin. Pivoting of the trigger housing 116 in the rearward direction, after the engagement of the gear pin 72 with the gear wheel 114 results in the increased force being applied to the tool head 35 and, consequently, increased tensioning of the cable tie 22.

Figure 9:
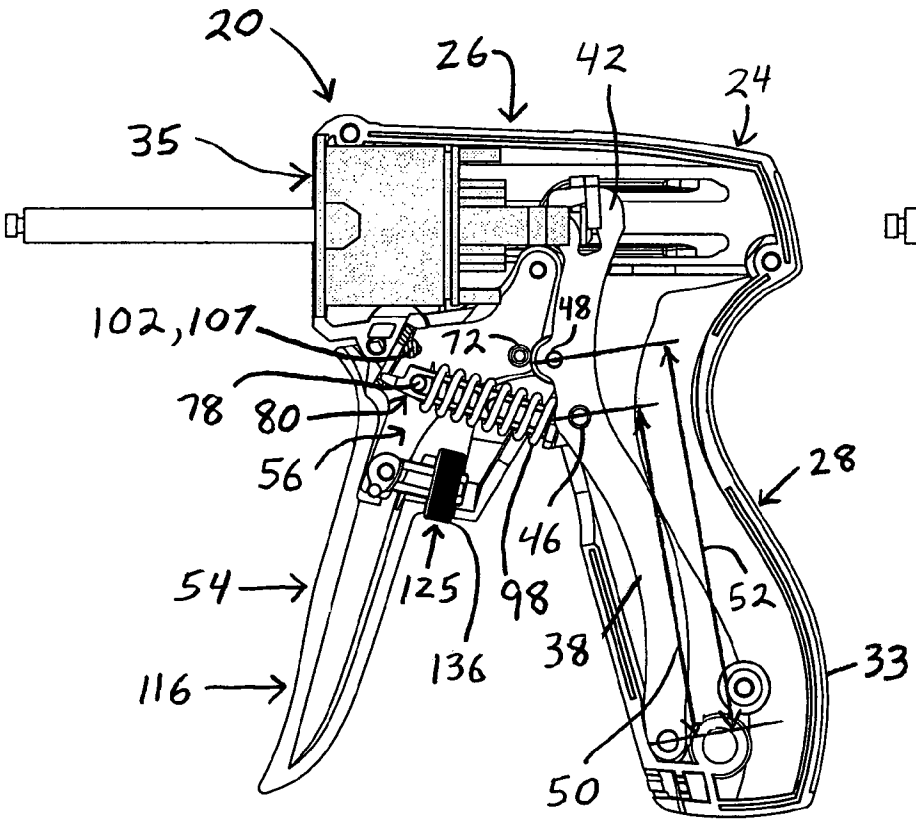
FIG. 9 is a side elevation view of the cable tie tool of FIG. 1 showing the left section of the tool handle removed, the variable trigger linkage being shown in the open position and having the automatic gear engaged, the hand-size adjustment of the variable trigger linkage being shown for a small hand.
Figure 12:
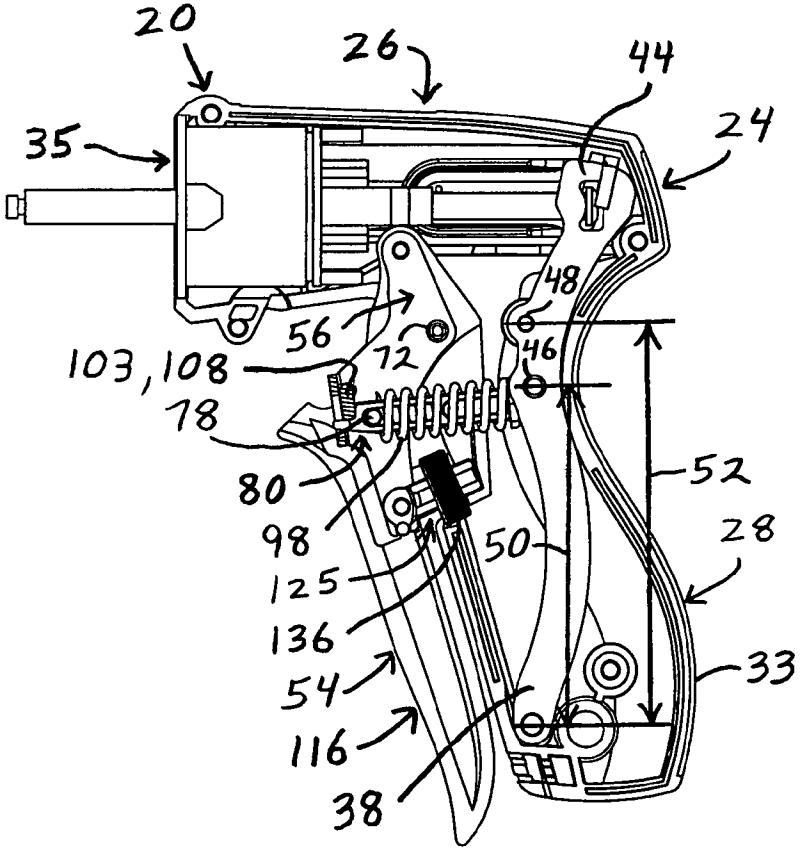
FIG. 12 is a side elevation view corresponding to FIG. 11 showing the variable trigger linkage in the closed position.

When the tension in the cable tie 22 is sufficiently increased, the hand of the user which grips the grip structure 28 and trigger housing 116 are relaxed. This results in the lever return spring 115 expanding which forcibly pivots the left and right levers 38, 39 in the forward direction. Additionally, the drive spring 98 expands which forcibly displaces the guide pin 78 in the forward direction relative to the push rod 80. Consequently, the guide pin 78 pivots the trigger frame 56 in the forward direction which, in turn, pivots the trigger housing 116 in the forward direction. If the hand of the user is sufficiently relaxed, the trigger housing 116 may be allowed to pivot sufficiently in the forward direction such that the levers 38, 39 are returned to the neutral positions 42 and the trigger housing 116 is returned to the rest position thereof, as shown in FIGS. 7 and 9.

The trigger linkage 54 is shifted from the automatic gear operation to the fixed gear operation by completely releasing the trigger housing 116 to allow the lever return spring 115 to pivot the levers 38, 39 in the forward direction to the neutral positions 42 and the drive spring 98 to pivot the trigger frame 56 in the forward direction such that the trigger housing 116 is returned to the rest position thereof. With the shift structure 100 in the disengaged position 107, this forward pivoting results in corresponding displacement of the body 82 of the push rod 70 in the forward direction such that the shift surface 96 is to the rear of the detent structure 103 by a slightly dimension. With the body 82 being held in this position relative to the detent structure 103, the left knob 105 of the shift structure 100 is displaced laterally to the right into abutment with the outer surface of the left flange structure 62. The left knob 105 is displaced with sufficient force to overcome the resistance of the locator spring 138 to the corresponding lateral translation of the locator projections 104. The moving of the left knob 105 into abutment with the left flange structure 62 results in a corresponding displacement of the detent structure 103 laterally to the right to a position midway between the left and right flange structures 62, 64 such that the detent structure is directly to the front of the shift surface 96 in the in the engaged position 108. When the shift structure 100 is in the engaged position 108, the detent structure 103 obstructs rearward translation of trigger frame 56 relative to the push rod 80. Examples of the shift structure 100 in the engaged position 108 and, consequently, the trigger linkage 54 configured for fixed gear operation are shown in FIGS. 11, 12, 13, and 14.

The user grasps the cable tie tool 20 such that the outer surface 30 of the grip structure 28 is grasped by the palm of the hand of a user and the fingers of the hand wrap around the outer surface 119 of the front section 118 of the trigger housing 116. The hand is then forcibly closed to draw the trigger housing 116 in the rearward direction toward the grip structure 28 to pivot the trigger housing from the open to closed positions thereof. Consequently, the trigger housing 116 is pivoted in the rearward direction which causes the front edge 122 of the rear section 117 to drive the adjustment wheel 136 in the rearward direction. This, in turn, causes the wheel 136 to pull the adjustment rod 126 in the rearward direction which results in pivoting of the trigger frame 56 in the rearward direction.

Pivoting of the trigger frame 56 in the rearward direction causes the web structure 60 to drive the shift structure 100 in the rearward direction such that the detent structure 103 contacts the shift surface 96 of the push rod 80. Continued pivoting of the trigger frame 56 in the rearward direction causes the detent structure 103 to forcibly translate the body 82 of the push rod 80 in the rearward direction. This translation of the push rod 80 is transmitted through the push rod pin 86 to the left and right levers 38, 39 to cause pivoting thereof in the rearward direction from the neutral position 42 to the tensioned position 44. The pivoting of the left and right levers 38, 39 in the rearward direction results in the compression of the lever return spring 115. Also, the rearward pivoting of the levers 38, 39, as a result of the coupling thereof to the tool head 35, causes in an increase in the tension in the cable tie 22 which is secured thereto.

The coupling between the trigger frame 56 and levers 38, 39 is provided by the push rod 80 and push rod pin 86 throughout the entire pivoting of the trigger frame. Consequently, the coupling between the trigger frame 56 and levers 38, 39 is provided through the near positions 46 and does not transfer to the distant position 48, in contrast to the automatic gear operation. As a result, the force applied to the tool head 35 by the rearward pivoting of the levers 38, 39 results from the coupling through the distant position 48 for the entire pivoting of the trigger housing 116 in the rearward direction from the open to closed positions. The coupling the fixed gear operation does not utilize the drive spring 98, also in contrast to the automatic gear operation.

Figure 13:
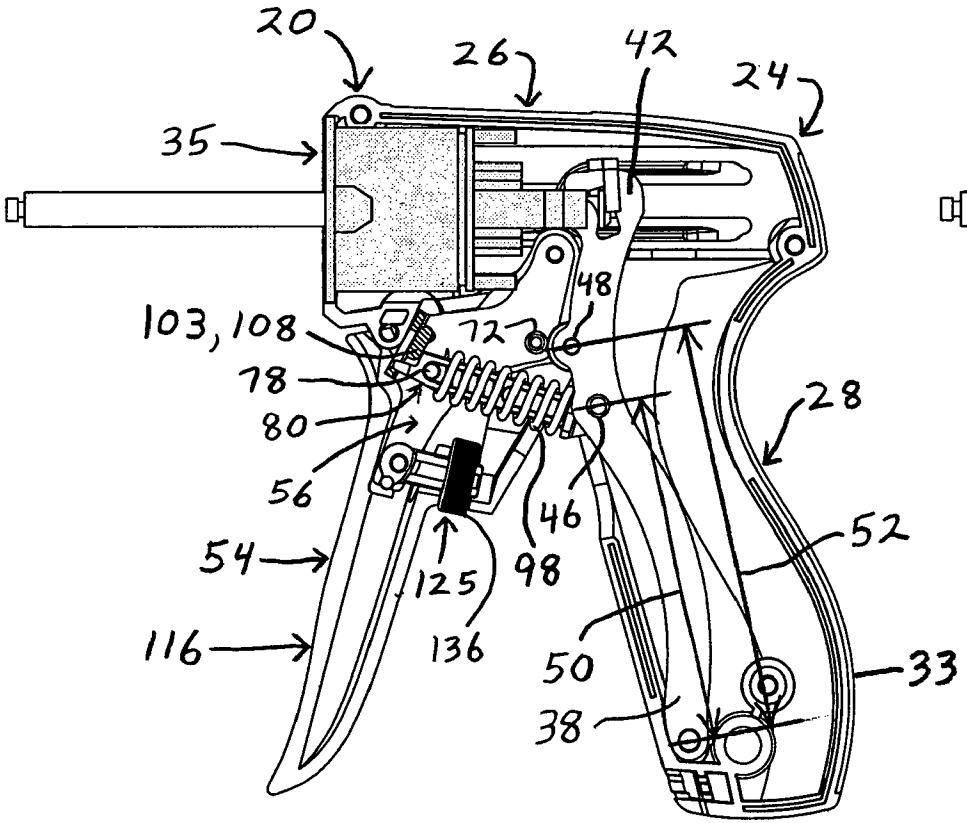
FIG. 13 is a side elevation view of the cable tie tool of FIG. 1 showing the left section of the tool handle removed, the variable trigger linkage being shown in the open position and having the fixed gear engaged, the hand-size adjustment of the variable trigger linkage being shown for a small hand.

When the tension in the cable tie 22 is sufficiently increased, the hand of the user which grips the grip structure 28 and trigger housing 116 are relaxed. This results in the lever return spring 115 expanding which forcibly pivots the left and right levers 38, 39 in the forward direction which drive the push rod pin 86 in the forward direction. Forward translation of the push rod pin 86 drives the push rod 80 and detent structure 103 in the forward direction which, in turn, drives the web structure 60 in the forward direction. Consequently, the trigger frame 56 pivots in the forward direction which, in turn, pivots the trigger housing 116 in the forward direction. If the hand of the user is sufficiently relaxed, the trigger housing 116 may be allowed to pivot sufficiently in the forward direction such that the levers 38, 39 are returned to the neutral positions 42 and the trigger housing 116 is returned to the rest position thereof, as shown in FIGS. 11 and 13.

While the invention has been described by reference to certain preferred embodiments, it should be understood that numerous changes could be made within the spirit and scope of the inventive concept described. Accordingly, it is intended that the invention not be limited to the disclosed embodiments, but that it have the full scope permitted by the language of the following claims.

What is claimed is:

1. A cable tie tool comprising:

a tool handle having a barrel structure;

a tool head supported within said barrel structure, the tool head having a forward end to which may be secured a cable tie for tensioning thereof;

an elongate lever supported within said tool handle by a pivotal connection thereto, said lever having near and distant positions thereon which have corresponding longitudinal reduced and increased separations from said pivotal connection, said lever being coupled to said tool head and pivotal between neutral and tensioned positions such that, when a cable tie is secured to said tool head, pivoting said lever from said neutral to tensioned positions causes said lever to apply a force to said tool head to increase the tension in the cable tie in proportion to the force applied to said tool head by said lever;

a variable trigger linkage supported within said tool handle by a connection thereto, said trigger linkage being coupled to said lever and movable between open and closed positions such that moving said trigger linkage from said open to closed positions causes said lever to pivot from said neutral to tensioned positions, said trigger linkage engaging said lever alternatively at said near or distant positions to provide said coupling to said lever such that, when a uniform force is applied to said trigger linkage for movement thereof from said open to closed positions, said engagement at said distant position results in said force applied to said tool head by said lever being greater than said force applied to said tool head by said lever which results from said engagement at said near position.

2. A cable tie tool according to claim 1, wherein said variable trigger linkage comprises a trigger frame which is connected to said tool handle, said trigger frame engaging said lever at said distant position, said trigger linkage further comprising a drive spring which is supported within said trigger frame for engagement with said lever at said near position, said coupling between said trigger linkage and lever being provided by said engagement between said drive spring and lever when a force applied to said trigger linkage for movement thereof between said open and closed positions is below a specific magnitude, said coupling between said trigger linkage and lever being provided by said engagement between said trigger frame and lever when a force applied to said trigger linkage for movement thereof between said open and closed positions is above a specific magnitude.

3. A cable tie tool according to claim 2, wherein said trigger frame is connected to said tool handle by a pivotal connection.

4. A cable tie tool according to claim 2, wherein said drive spring comprises a helical spring, said variable trigger linkage further comprising a push rod connected to said lever at said near position and selectively connected to said trigger frame, said push rod being contained within said drive spring in coaxial relation therewith, said connection of said push rod to said trigger frame preventing said engagement between said trigger linkage and lever at said distant position, said connection of said push rod to said trigger frame providing for said force applied to said tool head by said lever from said moving of said trigger frame from said open to closed positions being uniform for a uniform force applied to said trigger frame.

5. A cable tie tool according to claim 4, and further comprising a shift structure connected to said trigger frame for movement relative to said push rod between engaged and disengaged positions, said shift structure being connected to said push rod to provide said connection between said trigger frame and push rod when said shift structure is in said engaged position, said shift structure not obstructing said trigger linkage engaging said lever alternatively at said near or distant positions when said shift structure is in said disengaged position.

6. A cable tie tool according to claim 2, wherein said tool handle comprises a grip structure which depends from said barrel structure, said grip structure having an outer surface which is grasped by a palm of a hand of a user, said trigger frame and drive spring being located below said barrel structure, said variable trigger linkage further comprising a trigger housing connected to said tool handle such that said trigger housing has an outer surface which is grasped by a one or more fingers of the hand when said trigger linkage and grip structure are grasped by the hand, said outer surfaces of said trigger housing and grip structure being separated by a distance which defines a grip size, said trigger housing being movable in a forward and rearward direction relative to said trigger frame to vary said grip size, said variable trigger linkage further comprising a hand-size adjustment mechanism connected to said trigger frame and trigger housing, said adjustment mechanism providing for said movement of said trigger housing to vary said grip size, said adjustment mechanism being located below said drive spring.

7. A cable tie tool according to claim 1, wherein said variable trigger linkage comprises a trigger frame connected to said tool handle, said trigger frame being coupled to said lever to provide said coupling between said trigger linkage and lever, said variable trigger linkage further comprising an push rod connected to said lever at said near position and selectively connected to said trigger frame, said connection of said push rod to said trigger frame preventing said engagement between said trigger linkage and lever at said distant position, said connection of said push rod to said trigger frame providing for said force applied to said tool head by said lever from said moving of said trigger frame from said open to closed positions being uniform for a uniform force applied to said trigger frame.

8. A cable tie tool according to claim 7, and further comprising a shift structure connected to said trigger frame for movement relative to said push rod between engaged and disengaged positions, said shift structure being connected to said push rod to provide said connection between said trigger frame and push rod when said shift structure is in said engaged position, said shift structure not obstructing said trigger linkage engaging said lever alternatively at said near or distant positions when said shift structure is in said disengaged position.

9. A cable tie tool according to claim 1, wherein said tool handle comprises a grip structure which depends from said barrel structure, said grip structure having an outer surface which is grasped by a palm of a hand of a user, said variable trigger linkage comprises a trigger frame connected to said tool handle, said trigger frame being coupled to said lever to provide said coupling between said trigger linkage and lever, said variable trigger linkage further comprising a trigger housing connected to said tool handle such that said trigger housing has an outer surface which is grasped by a one or more fingers of the hand when said trigger linkage and grip structure are grasped by the hand, said outer surfaces of said trigger housing and grip structure being separated by a distance which defines a grip size, said trigger housing being movable in a forward and rearward direction relative to said trigger frame to vary said grip size, said variable trigger linkage further comprising a hand-size adjustment mechanism connected to said trigger frame and trigger housing, said adjustment mechanism providing for said movement of said trigger housing to vary said grip size.

10. A cable tie tool according to claim 9, wherein said trigger frame is located within said trigger housing.

11. A cable tie tool according to claim 9, wherein said hand-size adjustment mechanism comprises an adjustment rod which is connected to said trigger frame such that said adjustment rod has a forward-rearward orientation, said connection between said adjustment rod and trigger frame providing for said adjustment rod to be fixed in a forward or rearward direction relative to said trigger frame, said hand-size adjustment mechanism further comprising an adjustment wheel which is supported by said trigger housing such that said trigger housing follows said adjustment wheel when said adjustment wheel is displaced in said forward and rearward directions, said adjustment wheel being positioned relative to said trigger frame such that said adjustment rod extends through said adjustment wheel and rotation thereof produces forward or rearward translation thereof relative to said adjustment rod which causes corresponding forward or rearward translation of said trigger housing relative to said trigger frame for said varying of said grip size.

12. A cable tie tool according to claim 11, wherein said adjustment wheel is located within said trigger housing, said trigger housing having a cutout through which access is provided to an outer surface of said adjustment wheel for rotation thereof by direct contact of said adjustment wheel by the hand.

13. A cable tie tool according to claim 12, wherein said trigger housing has a lower surface and opposing side surfaces which adjoin said lower surface, said adjustment wheel being adjacent to lower and sides surfaces, said cutout extending continuously through said lower and side surfaces such that access is provided through said cutout to a bottom and side portions of said outer surface of said adjustment wheel.

* * * * *